United States Patent [19]

Wassink

[11] Patent Number: 4,987,594

[45] Date of Patent: Jan. 22, 1991

[54] STAND-ALONE UTILITY DEVICE WITH ANTITHEFT CODE WITH METHOD FOR ITS USE

[75] Inventor: Derk J. C. Wassink, Eindhoven, Netherlands

[73] Assignee: U.S. Philips Corporation, New York, N.Y.

[21] Appl. No.: 290,978

[22] Filed: Dec. 28, 1988

[30] Foreign Application Priority Data

Jul. 7, 1988 [NL] Netherlands ..... 8801717

[51] Int. Cl.[5] ..... H04K 1/02; H04K 3/00; G08B 13/14

[52] U.S. Cl. ..... 380/6; 340/571; 340/825.31; 380/2; 455/1

[58] Field of Search ..... 358/349; 380/2, 6, 7, 380/10, 20, 23; 455/1; 340/825.31, 571

[56] References Cited

U.S. PATENT DOCUMENTS

| | | | |
|---|---|---|---|
| 4,367,557 | 1/1983 | Stern et al. | 455/4 |
| 4,494,114 | 1/1985 | Kaish | 340/825.31 |
| 4,760,597 | 7/1988 | Hayes et al. | 380/10 |
| 4,769,838 | 9/1988 | Hasegawa | 380/7 |
| 4,837,820 | 6/1989 | Bellavia, Jr. | 380/7 |

FOREIGN PATENT DOCUMENTS

| | | |
|---|---|---|
| 3723931 | 6/1988 | Fed. Rep. of Germany . |
| 2589405 | 5/1987 | France . |
| 2611623 | 9/1988 | France . |

*Primary Examiner*—Stephen C. Buczinski
*Attorney, Agent, or Firm*—Michael E. Marion

[57] ABSTRACT

A stand-alone utility device for perceptible reproduction of signals, for example a radio receiver or a TV receiver, is protected from theft because the reproduction quality of the signals is disturbed in the case of unauthorized use by regular suppression of the signal, by generating bleeps or by a combination of both.

3 Claims, 4 Drawing Sheets

STAND-ALONE UTILITY DEVICE WITH ANTITHEFT CODE WITH METHOD FOR ITS USE

A. BACKGROUND OF THE INVENTION

A(1) Field of the invention

The invention generally relates to a stand-alone utility device for general consumer use and more particularly to those devices which only function properly if they are operated by authorized persons.

Stand-alone is herein understood to mean that the utility device can operate independently, like a car radio or another audio apparatus, a television receiver and the like. Such an apparatus is not subordinate to an external device and thus does not function like a peripheral apparatus which is subordinate to a central computer.

A(2) Description of the prior art

Modern stand-alone utility devices are generally provided with a plurality of independent or interrelated processing circuits which in very modern apparatuses are controlled by a control circuit in the form of a microcomputer. They receive status data from the microcomputer or apply status data to this computer. These status data indicate the state of a processing circuit, or the state to which it must be set. In a broadcasting receiver these status data represent, for example the frequency to which the receiver is tuned, the treble, volume, balance, etc.

To apply further status data to the different processing circuits, a plurality of keys are coupled to the microcomputer which comprises an internal non-volatile memory with a plurality of addressable memory locations each being addressable by means of a program counter. Each memory location comprises a processing step. A plurality of associated processing steps is referred to as control program. The number of such control programs stored in the internal non-volatile memory differs from device to device. A frequently occurring control program is the switch-on program performed in response to a switch-on command which is generated when switching on the device. Start-status data are then applied to the different processing circuits. For a broadcasting receiver this means that it is tuned to a given transmitter, while a given value is also assigned to the treble, balance, contrast, colour saturation, etc.

The sophisticated character of such stand-alone utility devices makes them a very attractive object for thieves. Particularly the number of car radio thefts has considerably increased in the last few years. To deter these thefts, the car radio was initially anchored mechanically in the car dashboard or console. However, this appeared to be insufficiently effective and moreover it resulted in the car interior being seriously damaged in the case of theft. Therefore it was later proposed to anchor the car radio in a position which was not visible or was hardly accessible, for example, under one of the car seats or in the trunk. To operate this car radio, a separate control panel was supplied which could be built in, for example in the steering wheel and was coupled to the car radio via a remote control system. Apart from the fact that these measures were still found to be inadequate in many cases, the use of a remote control system had a strong price-increasing effect.

The most modern way of rendering a car radio and generally a stand-alone utility device unattractive to thieves is the use of a so-called security program or "electronic lock". This is a control program in the microcomputer which is performed when a so-called security command is generated. This may be the case whenever the car radio is switched on if, after interruption the supply of power, supply voltage to the microcomputer is resumed. If this control program is executed, the receiver is said to be electronically locked and it does not function. The user is requested to identify himself by stating his so-called identity code. He can do this by using the control keys, or in a different way. The identity code stated by the user is compared with an antitheft code which is stored in the car radio in an antitheft code memory intended for this purpose. Only if the two codes are identical to each other is the receiver electronically unlocked, which means that it functions normally.

Initially, this had been arranged in such a way that the owner of the receiver itself could get access to the antitheft code memory in order to store or change an antitheft code which he had devised himself. Besides, the receiver was supplied without an antitheft code to the supplier. At that moment and during transport from the manufacturer to the customer, the receiver was not protected against theft. This was found to be a drawback in practice. However, the situation became even more serious when an ever increasing number of motorcar manufacturers started to build in car radios in their cars and subsequently transported this combination to the customer. Notably during this transport large quantities of car radios were stolen. For this reason the car radio manufacturer decided to store an antitheft code in the antitheft code memory, which antitheft code is different from car radio to car radio and is only made known to the customer. This has the drawback that such a car radio, after having been built in the car, cannot be checked by the car manufacturer on its correct operation, or if in fact the car radio has been built in properly.

B. OBJECT AND SUMMARY OF THE INVENTION

It is an object of the invention to provide a stand-alone utility device, particularly a car radio with an electronic lock in which the above-mentioned drawback is obviated.

According to the invention the control circuit is adapted to perform:

(a) a switch-on program in response to the switch-on command;

(b) a test program which is started after performing the switch-on program so as to establish whether a security command has occurred;

(c) a jamming program which is activated if it has been established in the test program that the security command has occurred, for disturbing the quality of the signal reproduction.

The invention will be particularly appreciated if it is considered that in known stand-alone utility devices secured against theft by means of an electronic lock the switch-on program is not traversed after the device has been switched on and when a security command has occurred, for example, because the power supply voltage has been interrupted. The device no longer reproduces signals and only reacts to given predetermined control keys with which the user can identify himself.

In the device according to the invention the switch-on program is always traversed after the device has been switched on. This device thereby reproduces signals and reacts to all control keys as if the security command had not occurred. However, the jamming program now ensures that the reproduction quality is very poor. However, this is no drawback if the device is only to be checked on its proper operation and if in the case of a car radio it is checked whether it has been built in correctly.

To check the device itself on its proper operation, the jamming program can be implemented in such a way that the signal reproduction is interrupted for some time in a predetermined rhythm.

In order to render unlawful use of such a device unattractive, the jamming program may also be implemented in such a way that jamming pulses, which are audible as bleeps, are supplied by the control circuit in a predetermined rhythm. The generation of these jamming pulses can be combined with the interruption of the signal reproduction, in which case these jamming pulses preferably occur when the reproduction of the desired signal is interrupted.

C. EXPLANATION OF THE INVENTION

C(1) Brief Description of the Figures

C(2) General Structure of a Radio Receiver

Figure 1:
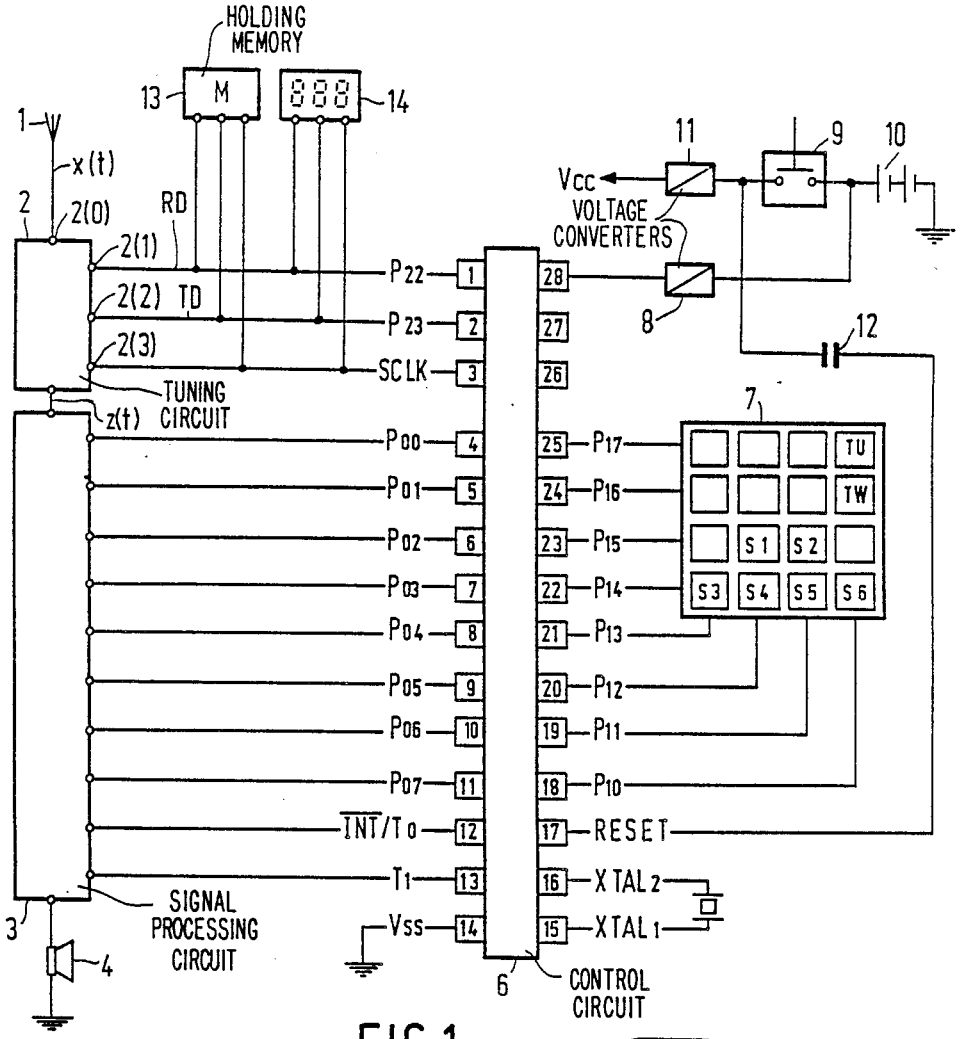
FIG. 1 shows the general structure of a radio receiver featuring the measures according to the invention.

FIG. 1 shows diagrammatically the general structure of a radio receiver. It has an aerial 1 for receiving a radio signal x(t) which is processed in a plurality of processing circuits. More particularly, the received radio signal is applied to an input 2(0) of a tuning circuit 2. It receives at a further input 2(1) a frequency band data component RD to tune the receiver to a frequency within one of the frequency bands LW, MW, SW, FM. This tuning circuit receives a tuning data component TD at an input 2(2) so as to tune it to a frequency within the selected frequency band. It also receives clock pulses SCLK at an input 2(3) which coincide with the bits of the frequency band data component RD and the tuning data component TD.

Tuning circuit 2 supplies a demodulated radio signal z(t) which is applied to a signal processing circuit 3 supplying the desired audio signal which is presented to a loudspeaker 4. In this signal processing circuit 3 volume, bass, treble, balance etc. of the audio signal are influenced by means of control signals. These control signals, as well as the frequency band data component RD, the tuning data component TD and the clock signal SCLK are supplied by a control circuit 6 in the form of a microcomputer. The Philips MAB8048, MAB8049, MAB8050, MAB8400 etc. can be chosen as examples. The following description is based on the use of the MAB8410 described in Philips Data Handbook, part 11, Apr. 1983, pp. 395–422. This microcomputer has 28 pins enumerated 1 to 28. Pin 1 (port P22) supplies the frequency band data component RD. Pin 2 (port P23) supplies the tuning data component TD and pin 3 supplies the clock signal SCLK. The pins 4 to 13 are connected to inputs of the signal processing circuit 3, and pin 14 receives a power supply voltage $V_{SS}$ which in this case is equal to ground potential. For the sake of completeness it is to be noted that the control signal which occurs at pin 6 (port P02) is utilized for the volume control of the reproduction. This volume can be reduced to zero, which is sometimes referred to as muting. Pin 7 (port P03) can supply a control signal in the form of series of pulses which are reproduced as bleeps via loudspeaker 4. If the ICs TEA6300 and TDA1516Q are used as signal processing circuit 3 in the way as described in Technical Publication No. 266 of Philips' Electronic Components and Materials, the control signal of pin 7 can be applied to a pin of the output amplifier IC TDA1516Q.

The following may be noted for the other pins of the microcomputer 6. A crystal oscillator determining the frequency of the internal generator is connected between the pins 15 and 16. A switch-on command can be applied to pin 17 so as to reset the program counter of the microcomputer to a certain position (zero). Pins 18 to 21 (ports P10–P13) are connected to the columns of sixteen keys arranged as a matrix on a control panel 7. The rows of this matrix are connected to the pins 22 to 25 (ports P14–P17) and the columns are connected to the pins 18 to 21 (ports P10–P13). Pins 26 and 27 are not used, while pin 28 is permanently connected via a voltage converter 8 to the positive terminal of a power supply source 10. This power supply source is, for example the battery of the car which supplies a voltage of 12 Volt and which in turn is converted by the voltage converter 8 into a power supply voltage of, for example 5 Volt. The power supply voltages for the other processing circuits of the radio receiver are supplied by a second voltage converter 11 in so far as these supply voltages are not equal to 5 Volt. This second voltage converter 11 is connected to the power supply source 10 via a switch 9.

As long as the power supply voltage has not been interrupted, the radio receiver operates in a normal manner, that is to say in the way as it may be expected to operate. However, if the power supply voltage has been interrupted, the user must first identify himself, that is to say he must introduce an identification code to regain normal operation of the radio receiver. This identification code must be identical to the antitheft code stored by the radio receiver manufacturer in a memory location of an internal memory of the microcomputer.

The control panel 7 is provided, inter alia for introducing this identification code and to this end it has a plurality of numbered keys denoted by S1, S2, S3, S4, S5, S6. In addition to the introduction of an identification code, these keys may have a number of other functions. To introduce an identification code comprising, for example three digits, these digits are successively applied to the microcomputer by operating the corresponding keys. For example, the key operated first (for example S5) indicates the hundred (5..) of the code, the key which is subsequently operated (for example S1) indicates the ten (.1.) and the key which is the last to be operated (for example S6) indicates the units (..6).

It is to be noted that the control panel also has two keys to change the tuning, namely a so-called tune-up key TU with which the tuning frequency can be increased and a tune-down key TW with which the tuning frequency can be decreased.

The switch-on command applied to the pin 17 is supplied by a capacitor 12 which is connected between the output of voltage converter 8 and pin 17. The program counter is reset to zero by this switch-on command.

In the embodiment of the radio receiver described the security command is constituted by a cut-off of the supply voltage at the pin 28. This event results in the contents of a predetermined memory location, which will be referred to as disconnect flag (abbreviated DC-FL) assuming the logic value "1".

The radio receiver shown in FIG. 1 is also provided with a holding memory 13 and a numerical display device 14 having inputs each being connected to the pins 1, 2, 3, of microcomputer 6. The holding memory 13 is intended to store a number of data therein which may not be lost when the receiver is switched off. These data may consist of, for example the frequency band and tuning data components of a plurality of preferred stations to which the radio receiver can be directly tuned by operating an appropriate key of a plurality of preselection keys which are also provided on the control panel 7 and for which the numbered keys are generally used. A preferred station is unambiguously associated with each numbered key.

C(3) Operation of the Radio Receiver

Figure 2:
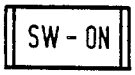
FIGS. 2 to 9 show charts to explain the operation of the radio receiver shown in FIG. 1.
Figure 3:
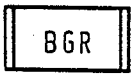

The operation of the radio receiver which is shown in FIG. 1 is entirely determined by the various control programs stored in the internal program memory of the microcomputer 6. A control program which is always present in such a receiver is the switch-on program SW-ON symbolically shown in FIG. 2. Although this is generally known, it is to be noted for the sake of completeness that primarily a frequency band data component RD and a tuning data component TD stored in given memory locations of the holding memory 13 are applied to the tuning circuit 2 so that the receiver is immediately tuned to the corresponding transmitter after it has been switched on. This may be a predetermined transmitter but also the transmitter to which the receiver had been tuned when it was switched off. Another program which is always present in such a receiver is the background program BGR symbolically shown in FIG. 3. This program checks, inter alia whether a control panel key has been depressed. If so, a control program associated with the relevant control panel key is started so that the said function is performed.

Figure 4:
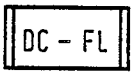

The present radio receiver further has a disconnect flag program DC-FL which is shown diagrammatically in FIG. 4. This program influences the disconnect flag in the memory of the microcomputer when the power supply voltage has been interrupted. More particularly, the logic value "1" is assigned to it in that case.

Figure 5:
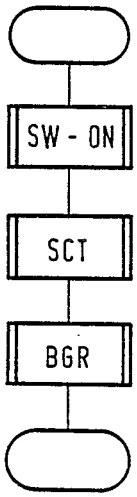

The switch-on program is started immediately after the receiver has been switched on, that is to say when $V_{CC}$ is unequal to zero. Due to this switching on a switch-on command is applied to pin 17. This sets the program counter to its zero position which corresponds to the commencement of the switch-on program. In the relevant receiver the security program SCT is performed after this switch-on program, and it is followed by the background program. All this is shown diagrammatically in FIG. 5.

Figure 6:
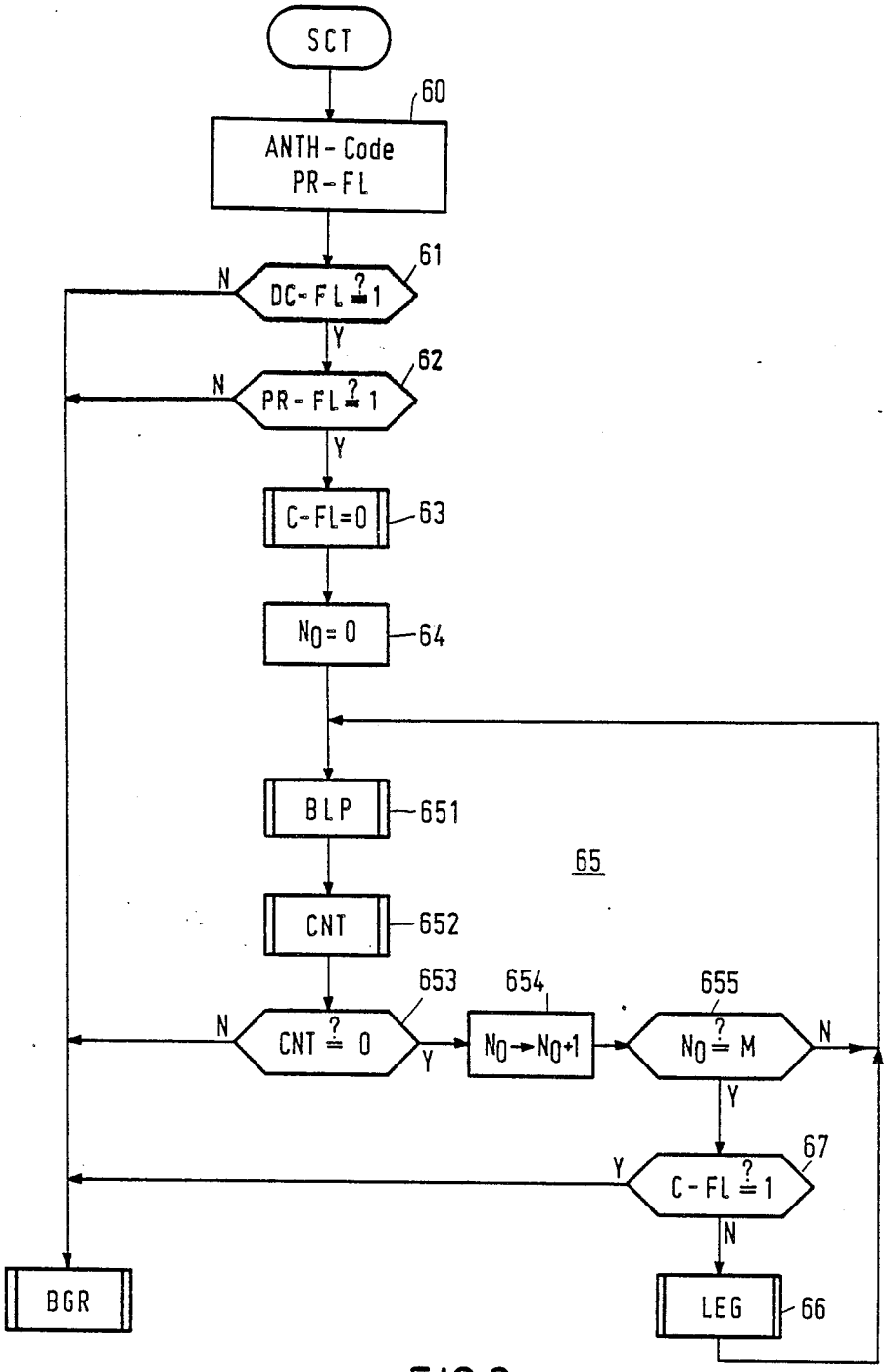

A possible basic version of this security program is shown in FIG. 6. This program comprises a step 60 in which an antitheft code (ANTH Code) programmed by the manufacturer of the radio receiver in the memory of the microcomputer, as well as a protection flag PR-FL of holding memory locations are read and transferred to a working memory of the microcomputer. The protection flag PR-FL indicates whether the antitheft code is active or not. In the first case it has the logic value "1" and in the second case it has the logic value "0". In a step 61 it is subsequently checked whether the power supply voltage has been interrupted, in other words whether the disconnect flag is logic "1". If this is not the case, the background program BGR is started. However, if this is the case, it is checked in a step 62 whether the antitheft code is active, in other words whether PR-FL is logic "1". If this is not the case, the background program is carried out. If the antitheft code is active, the content of a given memory location is rendered logic "0" in a step 63. This content is referred to as code flag and denoted by C-FL. Subsequently the value of zero is assigned to a count $N_o$ in a step 64 and an jamming program 65 is started. This program comprises a bleep program 651 by means of which a series of pulses at port PO3 of the microcomputer is generated, which pulse series results in an audible bleep. After generating this series of pulses a counter present in the microcomputer is preset to a predetermined value in a step 652 and subsequently it counts down under the control of the system clock until it has reached the value of zero. The preset value is chosen to be such that the return of the count to zero takes, for example five seconds. In a step 653 it is continuously checked whether the counter has already reached the zero position. As long as this is not the case, the background program is performed. As soon as this is the case, the count $N_o$ is augmented by one in a step 654 and subsequently it is checked in a step 655 whether the new value of $N_o$ has reached a predetermined value M and if this is not the case, a series of pulses is again applied to the port PO3 so that a short bleep becomes audible again. This is continued until $N_o$ has reached the value M. It is considered to assign such a value to M that the interference program 65 is traversed in five minutes. In practice this period of time is found to be amply sufficient to enable the employee mounting such a radio receiver in a car to check whether the receiver itself operates properly and whether he has built in the receiver correctly. It is to be noted that the background program is performed each time between two bleeps. This means that the receiver then functions normally.

As described in the foregoing, the jamming program is performed because the disconnect flag has the logic value "1" in the case of an active antitheft code, in other words because the power supply voltage has been interrupted. To give the disconnect flag the logic value "0", an identification program 66 is provided which is performed when the count $N_o$ has assumed the value M, in other words when the five minutes of interfered reception have elapsed and when it has been established in a step 67 that the code flag has not yet assumed the logic value "1". If it had done so, the background program is performed. If the code flag is logic "1", this means that the owner has successfully identified himself after the supply of power supply voltage has been restored.

Figure 7:
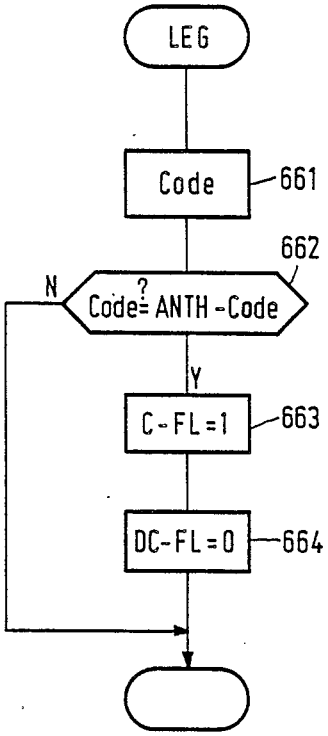

This identification program 66 is shown diagrammatically in FIG. 7. It comprises a code read program 661 in which the user is requested to depress three numbered keys in succession. The significance of an identification code is assigned to the combination of the numbered keys thus depressed. In a step 662 this code entered by the user is compared with the antitheft code programmed by the manufacturer. If the two codes are identical, the logic value "1" is subsequently assigned to the code flag in a step 663 and the logic value "0" is assigned to the disconnect flag in a step 664. Subsequently the jamming program 65 is traversed again. The latter is also the case if the identification code entered by the user is not identical to the antitheft code. If the identification code is identical to the antitheft code, the microcomputer starts the background program after it has traversed the jamming program 65 for five minutes.

Thus, if the logic value "0" is assigned to the disconnect flag DC-FL in step 664 after the supply of power supply voltage has been restored, the jamming program 65 is no longer performed in the case of normal further use. In fact, if the receiver is switched on again after it has been switched off without the power supply voltage having been interrupted, the microcomputer will immediately carry out the background program due to the presence of step 61.

C(4) Extensions and Alternatives

Figure 8:
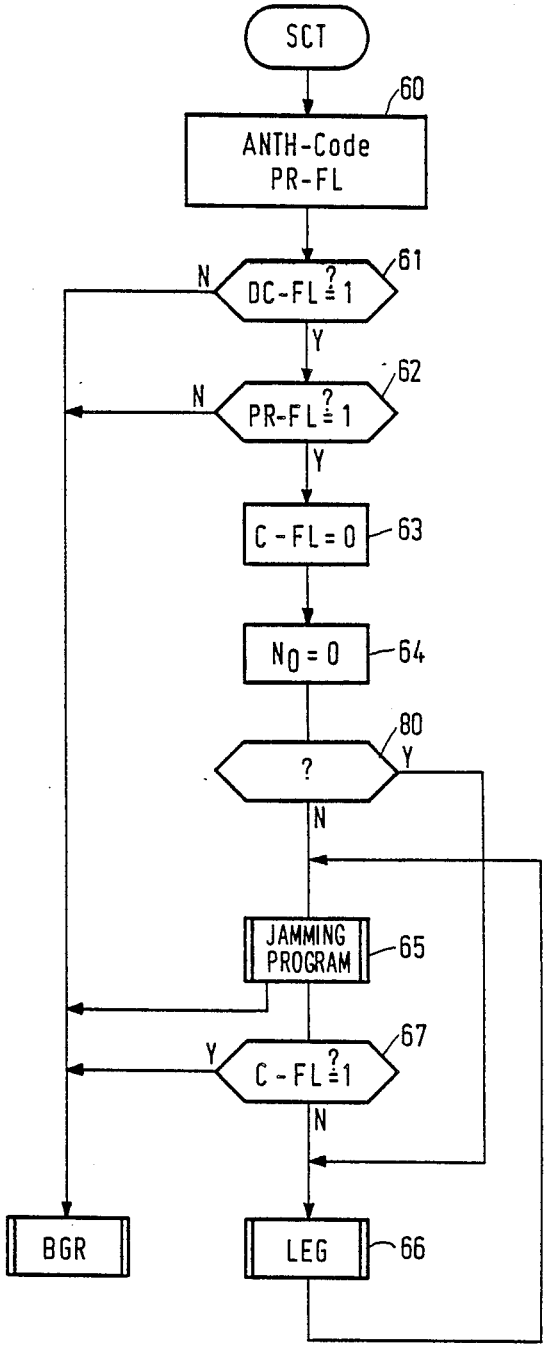

In the receiver described the microcomputer always runs through the jamming program when the power supply voltage has been interrupted. This means that the user must always wait for five minutes and listen to an interfered program before he can enter his identification code, whereafter he can enjoy another five minutes of an interfered program. The first-mentioned waiting time can be eliminated by inserting a step 80 between step 64 and jamming program 65 as is shown in FIG. 8. In this step it is checked whether a predetermined further key has been suppressed simultaneously upon switching on the receiver by operating an on/off key; in practice the tune-up key will be chosen for this purpose. If this is not the case, the interference program 65 is performed, or otherwise the identification program is started immediately.

Figure 9:
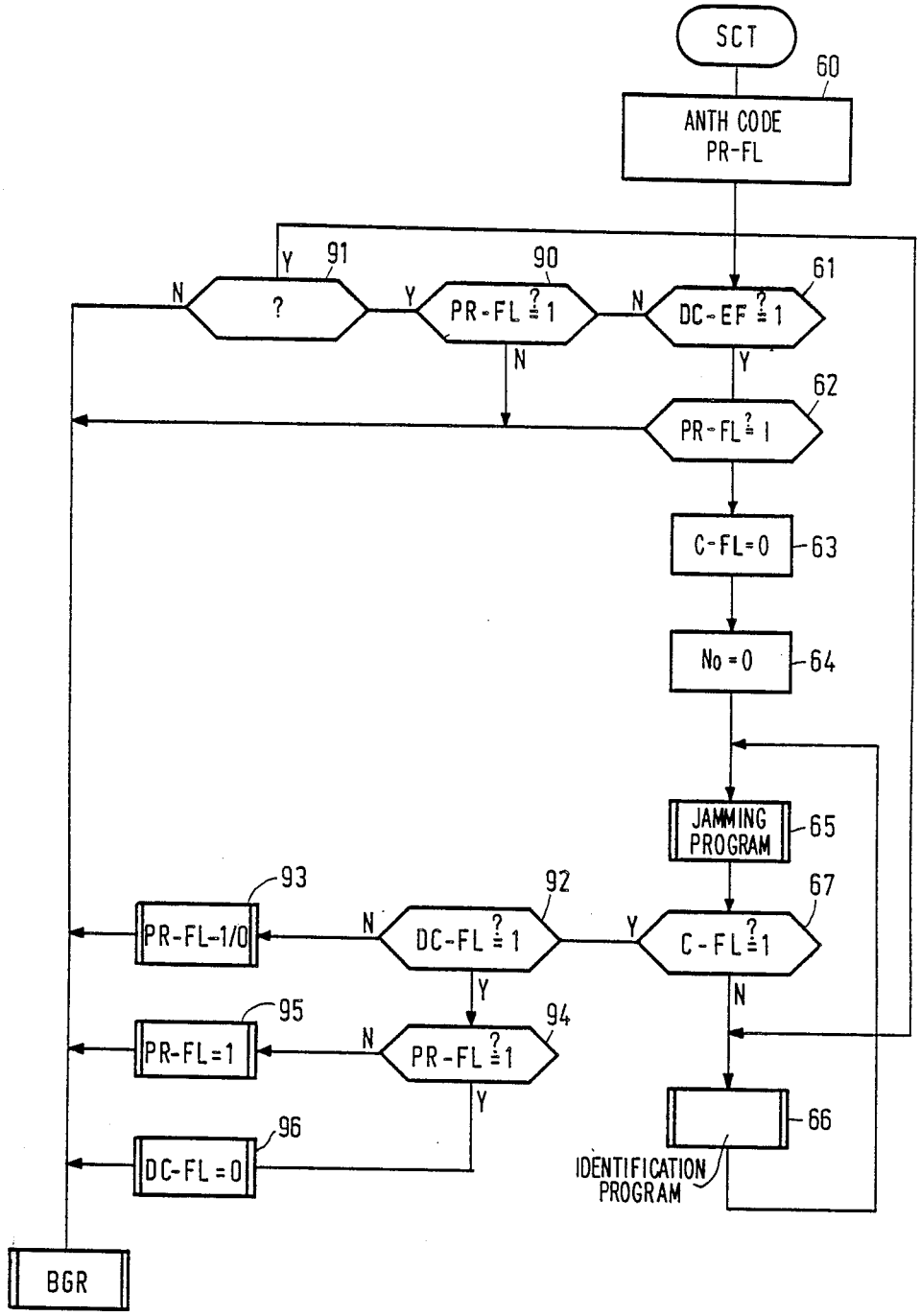

Under certain circumstances the user may not want to activate the antitheft code. In that case it is normally usable, even if the power supply voltage has been interrupted. To give the user this possibility, he should depress a predetermined further key simultaneously upon switching on the receiver by operation of the on/off key. The tune-down key is considered for this purpose. In that case the program shown diagrammatically in FIG. 9 is performed, which largely corresponds to the program diagrammatically shown in FIG. 6. In the program shown in FIG. 9 it is checked in a step 90 whether the antitheft code is active when the power supply voltage has not been interrupted (step 61). If the antitheft code is not active, the background program is further carried out. If the antitheft code is active, it is checked in a step 91 whether the tune-down key has been depressed upon switching on the receiver. If this is not the case, the background program is further performed; if this is the case, there is a change-over to the identification program 66, followed by the jamming program 65 and step 67. If it is established in step 67 that the code flag has the logic value "1", it is subsequently checked in a step 92 whether the disconnect flag has the value "1". If this is not the case, it is assumed that the user wants to activate the antitheft code if this code is not active, or conversely. This takes place in step 93. If it is established in step 92 that the disconnect flag indeed has the value "1", it is checked in a step 94 whether the antitheft code is active. If this is not the case, the user apparently intends to activate it. This is effected in a subsequent step 95. If the antitheft code is indeed active, the value "0" is assigned to the disconnect flag in a step 96. It is to be noted that in this case step 664 in the identification program 66 (see FIG. 7) is redundant.

The jamming program 65 shown in FIG. 6 is adapted to generate an audible bleep every five seconds for five minutes. However, it is alternatively possible to replace the program 651 for generating this bleep by a program reducing the volume of the received audio signal to zero, in other words by suppressing the signal. A combination of using both possibilities in practice is being considered, namely such that the bleeps are generated and rendered audible in those periods when the reproduction of the received audio signal is suppressed.

What is claimed is:

1. A stand-alone utility device for perceptible reproduction of signals supplied by a signal source, said utility device having means for deterring its theft and comprising:

reproducing means for receiving said signals;

storage means coupled to said reproducing means for storing a pre-programmed antitheft code;

means coupled to said storage means for generating a security command in response to an unauthorized use of said device;

control means comprising a program memory, coupled to said generating means and adapted to perform:

(a) a switch-on program in response to a switch-on command;

(b) a test program to establish whether a security command has occurred; and (c) a jamming program, activated if said security command has occurred, for disturbing the quality of the signal reproduction;

wherein said switch-on program, said test program and said jamming program are stored in said program memory.

2. A stand-alone utility device as claimed in claim 1 in which said control means is further adapted to block the reproducing means in a predetermined rhythm from reproducing signals.

3. A stand-alone utility device as claimed in claim 2 in which said control means is adapted to supply jamming pulses in a predetermined rhythm and in that the reproducing means are adapted to receive said jamming pulses for their reproduction.

* * * * *